United States Patent [19]

Fosher

[11] 4,386,437

[45] Jun. 7, 1983

[54] HEADWEAR HAVING INTERIOR POCKET

[76] Inventor: Donald H. Fosher, 7266 Creveling Dr., University City, Mo. 63130

[21] Appl. No.: 302,969

[22] Filed: Sep. 17, 1981

[51] Int. Cl.[3] ..... A42B 1/02; A61F 9/00

[52] U.S. Cl. ..... 2/199; 2/10

[58] Field of Search ..... 2/199, 196, 185 R, 209.1, 2/10

[56] References Cited

U.S. PATENT DOCUMENTS 1,033,518 7/1912 Bader ..... 2/10

1,161,637 11/1915 Dunn ..... 2/199

4,312,076 1/1982 Gamm ..... 2/199

*Primary Examiner*—Doris L. Troutman

*Attorney, Agent, or Firm*—Senniger, Powers, Leavitt and Roedel

[57] ABSTRACT

Crowned headwear having an interior pocket attached to the inside of the front of the crown which extends upward within a space in the crown between the head of the wearer and the inside of the crown. The pocket is of flexible material for expanding into the space to accommodate articles to be carried within the pocket.

12 Claims, 4 Drawing Figures

HEADWEAR HAVING INTERIOR POCKET

BACKGROUND OF THE INVENTION

This invention relates to headwear, such as baseball caps, and in particular it relates to headwear having an interior pocket.

Persons engaged in outdoor activities, such as jogging, softball, or fishing may not have a pocket in their clothing to carry their keys and wallet. Even if they do have pockets in their trousers or shirt, they may prefer not to carry the objects in those pockets for fear of losing them, being injured by them when sliding, etc., or getting them wet while wading. As an example, softball players usually wish to carry their keys, driver's license, and a small amount of spending money with them to the game and want a secure place to keep these objects on their person without placing them in their trousers.

Fisherman and hunters often tuck fishing or hunting licenses in the bands of their hats to display them to authorities when regulations so require, but this may be unsatisfactory due to wet weather conditions or to the risk of loss.

SUMMARY OF THE INVENTION

Among the several objects of this invention may be noted the provision of headwear, such as baseball caps, having an interior pocket; the provision of such headwear with a pocket of sufficient size to hold keys, driver's license and spending money; the provision of such headwear in which the pocket is not visible from the outside of the headwear; the provision of such headwear in which objects put in the pocket are not likely to fall out; and the provision of such a baseball cap with a pocket which requires little or no extra sewing to include the pocket in order to hold down the cost of the cap; and the provision of such headwear in which an article within the pocket, such as a fishing or hunting license, is visible from the outside of the headwear for display purposes.

In general, headwear of this invention comprises a crown shaped to provide a space within the crown between the head of the wearer and the inside surface of the front of the crown. A web is mounted on the inside of the crown at the front of the crown extending upward within the space at the front of the crown and is attached to the inside of the crown to form a pocket. The pocket has an opening at its upper end for access thereto and is of flexible material for expanding into the space thereby to accommodate articles carried within the pocket.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENTS

Figure 1:
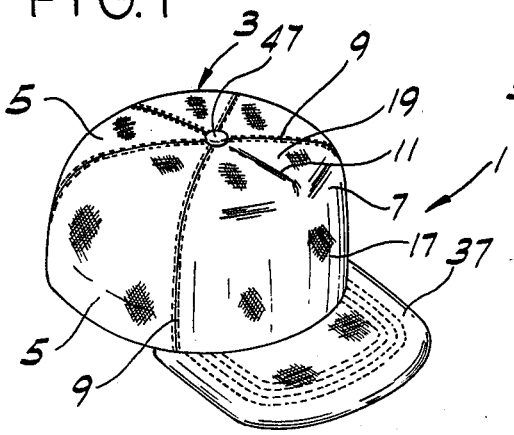
FIG. 1 is a perspective view showing a baseball cap having an interior pocket embodying the invention.

Referring first to FIG. 1, the invention is provided in headwear, generally designated 1, of the type generally known as a baseball-style cap. In the following description of the cap, the parts of the cap are described generally in the order in which they are assembled and the method of assemably is explained.

Figure 2:
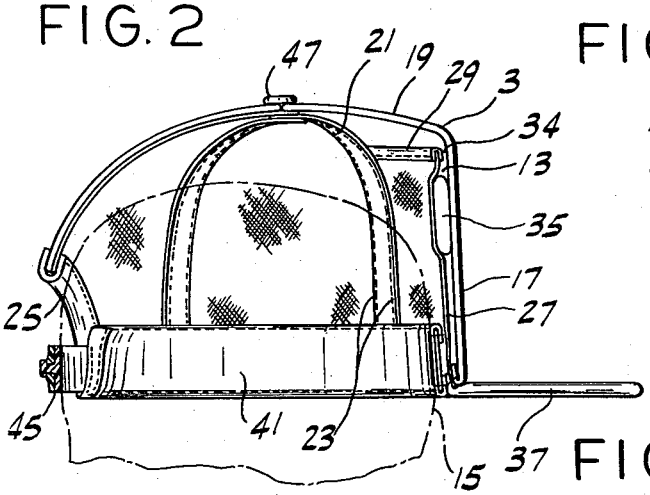
FIG. 2 is a longitudinal section of the cap of FIG. 1 illustrating the interior pocket within a space between the crown of the cap and the head of the wearer with an article in the pocket.
Figure 5:
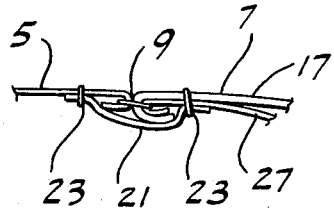
FIG. 5 is an enlarged section illustrating the construction at the side of the pocket.

First, a cap crown 3 is formed of a plurality of wedge-shaped panels joined at their side edges, including a plurality of (four) rear panels 5 of nylon mesh material for ventilation and a front panel 7 of opaque nylon tricot. The front panel is wider than the rear panels, forming approximately the front one-third of the crown. Seams joining the front panel to the rear panels are indicated at 9 (for details see FIG. 5). Front panel 7 is a single piece and has a dart 11 at its upper end whereby the front panel is shaped to provide a space 13 (see FIG. 2) within the crown between the head of the wearer 15 and the inside surface of the front of the crown, i.e., of the front panel. So shaped, the front panel comprises a substantially vertical front portion 17 and a top portion 19 substantially at the level of the top of the crown extending rearwardly from the front portion. Space 13 is on the inside of the front portion below the top portion. However, the front panel may also be formed of several pieces cut and sewn together and sewn to the rear panels to provide the desired space 13 within the crown. A bias binding 21 is sewn over seams 9 joining the panels, the seams for the bias binding being indicated at 23. The two rear-most rear panels are partially cut away to provide a semicircular opening 25 at the lower rear of the crown.

Figure 3:
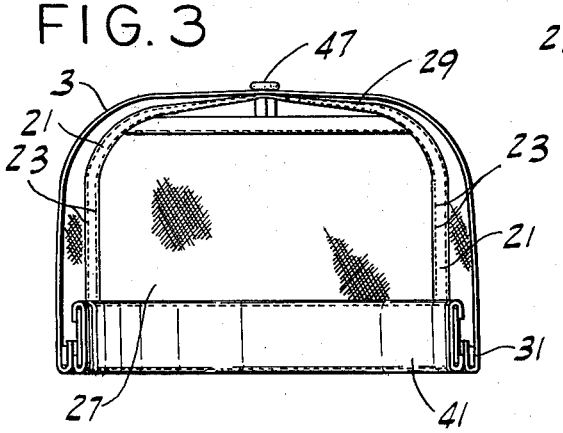
FIG. 3 is a transverse section of the cap illustrating the pocket.

A substantially rectangular web 27 of substantially the same width as vertical front portion 17 of front panel 7 is attached to the inside of the crown to form an internal pocket. The web extends upward from the lower edge of the front panel on the inside of the front panel within space 13 between the front panel and the head of the wearer. It has a bias binding 29 (FIG. 3) folded over its upper edge and sewn in place. The web, which is of nylon mesh material, is attached to the crown at the side edges of the front panel by the same seams 9 which join the front panel 7 to the two rear panels 5 adjacent to it.

Figure 4:
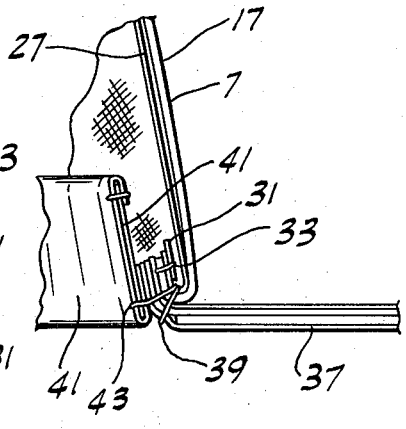
FIG. 4 is an enlarged section illustrating the construction at the lower edge of the pocket.

A size strip or band 31 is sewn to the crown, extending around the inside of the crown around the lower edge of the panels. The resulting seam is indicated at 33 (FIG. 4). The size band prevents the lower edge of the crown from expanding or contracting in length, to provide a good, long-lasting fit. Seam 33, in joining the band to the panels, also attaches the lower edge of web 27 to the crown at the lower edge of the front panel.

The pocket has an opening 34 (see FIG. 2) at its upper end for access to the pocket resulting from the fact that the upper edge of the web, to which bias binding 29 is sewn, is unattached to the crown across the entire top edge of the web. However, the web need be unattached to the crown along only a portion of the web for access to the pocket. The upward extend of the web is nearly to the top of the cap. Since the web is of the flexible nylon mesh material, it can expand into space 13 between the head of the wearer and the inside surface of the crown to accomodate articles 35 carried within the pocket.

A visor 37 is then attached. It extends forward from the lower edge of front panel 7, being attached by a seam 39 through the lower edges of the web and front panel and the rear edge of the visor (see FIG. 4).

A sweatband 41 is sewn around the inside of the crown around the lower edges of the panels. As shown in FIG. 4, the seam 43 attaching the sweatband is through the lower edges of the web and front panel, the rear edge of the visor, and the lower edge of the sweatband. A gap is left in the sweatband at semicircular opening 25 in the crown. An adjustment snap tab 45 for adjusting the cap size is sewn to the crown and sweatband and extends across opening 25 to close the gap in the sweatband at the rear of the crown.

Finally, a button 47 is clipped to the top of the hat at the point where front panel 7 and all of rear panels 5 meet.

If desired, the finished cap is then blocked.

The interior pocket in the above-described headwear is of sufficient size to hold keys, driver's license and spending money, which is particularly important to wearers of baseball-style caps who participate in outdoor athletic events. The pocket conveniently takes advantage of space within the headwear between the front of the crown and the head of the wearer. Because no additional seams are required and only a small rectangle of fabric is added to form the pocket, the cap does not cost substantially more to manufacture than a conventional cap. Objects put in the pocket are not likely to fall out. Due to the opaque front panel, objects in the pocket are not visible from the outside of the headwear.

Figure 6:
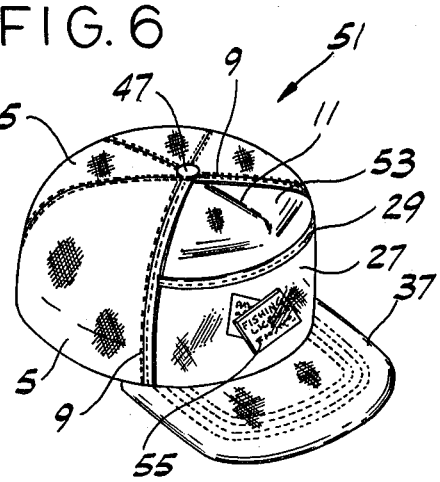
FIG. 6 is a perspective view like FIG. 1 of an alternative embodiment in which the cap has a transparent front panel with an object visible within the interior pocket.

In the alternative embodiment shown in FIG. 6, a baseball cap generally designated 51, which is generally identical to the cap of FIG. 1, is provided with a front panel 53 of substantially transparent, rather than opaque, material whereby an object contained in the pocket, such as a fishing or hunting license 55, for example, may be visible from outside of the cap. The license will then be visible to the authorities as required, but will be kept dry and safe from accidental loss.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. Headwear comprising a crown shaped to provide a space within the crown between the head of a wearer and the inside surface of the front of the crown, and a web on the inside of the crown at the front of the crown extending upward within said space, the web being attached to the inside of the crown to form an internal pocket, the pocket having an opening at its upper end providing access from within the crown to the interior of the pocket, said web being of flexible material for enabling inward expansion of the pocket to accommodate articles carried within the pocket.

2. Headwear as set forth in claim 1 wherein the front of the crown is opaque thereby to conceal the presence of articles within the pocket.

3. Headwear as set forth in claim 1 wherein the crown has a seam at its lower edge around its perimeter and the lower edge of the web is attached to the crown by the seam.

4. Headwear as set forth in claim 3 wherein the web is generally rectangular and the side edges of the web are attached to the crown by seams.

5. Headwear as set forth in claim 1 in the form of a baseball-style cap wherein the crown comprises a plurality of wedge-shaped panels joined by seams at their side edges and wherein the web is attached to the crown by two of said seams.

6. Headwear as set forth in claim 5 further comprising a band around the inside of the crown at the lower edges of the wedge-shaped panels joined to the panels by a seam which further attaches the lower edge of the web to the crown.

7. Headwear as set forth in claim 5 wherein the wedge-shaped panels include a plurality of rear panels and one front panel wider than the rear panels, and wherein the web is of substantially the same width as the front panel and is affixed to the crown by seams joining the side edges of the front panel to the rear panels.

8. Headwear as set forth in claim 7 wherein the front panel has a substantially vertical front portion and a top portion substantially at the level of the top of the crown extending rearwardly from the front portion whereby said space is provided within the crown on the inside of the front portion below the top portion.

9. A baseball-style cap having an interior pocket comprising:

a crown formed of a plurality of wedge-shaped panels joined at their side edges, including a plurality of rear panels and a front panel wider than the rear panels, the front panel being shaped to provide a space within the crown at the front of the crown between the head of the wearer and the inside surface of the front panel;

a visor extending forward from the front panel;

a band around the inside of the crown around the lower edges of the panels; and a web of substantially the same width as the front panel attached to the inside of the crown and extending upward from the band on the inside of the front panel within said space to form an internal pocket, the web being attached at its bottom to the crown at the lower edges of the front panel by a seam joining the band to the front panel, and the web being attached to the crown at its side edges by two seams joining the front panel to two of the rear panels, and the upper edge of the web being unattached to the crown for access to the pocket.

10. A cap as set forth in claim 9 wherein the rear panels are of mesh material for ventilation and the front panel is of opaque material whereby the presence of the pocket is concealed.

11. A cap as set forth in claim 9 wherein the front panel is of substantially transparent material whereby any object contained in the pocket, such as a fishing license, is visible.

12. A cap as set forth in claim 9 wherein the front panel comprises a substantially vertical front portion and a top portion substantially at the level of the top of the crown extending rearwardly from the front portion thereby providing said space within the crown on the inside of the front portion below the top portion.

* * * * *